US007248245B2

(12) United States Patent
Adachi et al.

(10) Patent No.: US 7,248,245 B2
(45) Date of Patent: Jul. 24, 2007

(54) LIQUID CRYSTAL DISPLAY DEVICE AND MANUFACTURING METHOD THEREOF, AND DRIVE CONTROL METHOD OF LIGHTING UNIT

(75) Inventors: Katsumi Adachi, Kashiba (JP); Hiroyuki Handa, Hirakata (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 0 days.

(21) Appl. No.: 11/483,731

(22) Filed: Jul. 11, 2006

(65) Prior Publication Data

US 2007/0030241 A1 Feb. 8, 2007

Related U.S. Application Data

(62) Division of application No. 10/183,461, filed on Jun. 28, 2002, now Pat. No. 7,088,334.

(51) Int. Cl.
*G09G 3/36* (2006.01)

(52) U.S. Cl. ..... 345/102; 345/204

(58) Field of Classification Search ..... 345/83–102, 345/204, 690

See application file for complete search history.

(56) References Cited

U.S. PATENT DOCUMENTS 4,298,869 A * 11/1981 Okuno ..... 345/82
5,895,128 A 4/1999 Kishimoto et al. ..... 396/61
6,151,004 A 11/2000 Kaneko ..... 345/88
6,243,059 B1 6/2001 Greene et al. ..... 345/88
6,456,266 B1 9/2002 Iba et al. ..... 345/87
6,573,882 B1 6/2003 Takabayashi ..... 345/102
6,618,031 B1 * 9/2003 Bohn et al. ..... 345/83
6,747,617 B1 6/2004 Kawashima ..... 345/76
6,791,527 B2 * 9/2004 Yoshinaga et al. ..... 345/102
6,867,757 B1 3/2005 Nakamura ..... 345/83
7,175,302 B2 * 2/2007 Kazar et al. ..... 362/231

FOREIGN PATENT DOCUMENTS

JP 2000-28984 1/2000

* cited by examiner

*Primary Examiner*—Richard Hjerpe
*Assistant Examiner*—Jean Lesperance
(74) *Attorney, Agent, or Firm*—McDermott Will & Emery LLP

(57) ABSTRACT

A liquid crystal display device includes a liquid crystal display panel having a first substrate, a second substrate, a liquid crystal disposed between the first substrate and the second substrate, plural pixel electrodes arranged in a matrix on a second substrate, a counter electrode provided on one of first substrate and the second substrate and plural switching elements connected to the respective plural pixel electrodes, a display drive control unit for driving the liquid crystal disposed between each of the pixel electrodes and the counter electrode, a lighting unit having LEDs emitting light of respective red, green and blue colors, and a lighting device control unit for making each LED of color perform time-division light emission in synchronization with the switching of each of the switching elements.

4 Claims, 15 Drawing Sheets

LIQUID CRYSTAL DISPLAY DEVICE AND MANUFACTURING METHOD THEREOF, AND DRIVE CONTROL METHOD OF LIGHTING UNIT

RELATED APPLICATION

This application is a divisional application of Ser. No. 10/183,461, filed Jun. 28, 2002 now U.S. Pat. No. 7,088,334, which claims priority of Japanese Patent application No. 2001-196036, filed Jun. 28, 2001, and the contents of which are herewith incorporated by reference.

BACKGROUND OF THE INVENTION

1. Field of the Invention

The present invention relates to a liquid crystal display device and a manufacturing method thereof, and a drive control method of a lighting unit, and in particular relates to a liquid crystal display device of a field sequential system and a manufacturing method thereof, and a drive control method of a lighting unit used for such a liquid crystal display device.

2. Description of the Related Art

As a color display system for a liquid crystal display device, the field sequential system is known in which the color display is performed by making plural different colors sequentially emit light at a predetermined period and performing an ON/OFF control of pixel electrodes in synchronization therewith, and is disclosed in Japanese Patent Laid-Open No. 2000-28984, for example.

The liquid crystal display device described in this publication includes, as shown in a perspective-projected view of FIG. 13, a liquid crystal display panel 50, a display drive control unit 57, a backlight 63 and a lighting drive control unit 64.

The liquid crystal display panel 50 is configured by laminating a polarizing film 51, a first glass substrate 52, a common electrode 53, pixel electrodes 54, a second glass substrate 55 and a polarizing film 56 in this order. Orientation films (not shown in the figure) are formed on facing surfaces of the common electrode 53 and the pixel electrodes 54, respectively, and a liquid crystal 65 is sandwiched between the orientation films. Corresponding to TFTs 58 which are switching elements formed at the intersections of plural gate lines 59 and plural source lines 60, plural pixel electrodes 54 are provided.

The display drive control unit 57 has a gate driver, source driver and so on, and is able to selectively supply a voltage signal to each gate line 59 and each source line 60 from the gate driver and the source driver. By supplying the voltage signal to the gate line 59, the TFT 58 connected with the gate line 59 can be switched, and a voltage is applied to the pixel electrode 54 from the source line 60 via the TFT 58 which is in ON state, thus capable of driving the liquid crystal 65. Another configuration may be available in which the common electrode 53 is formed on the side of the first glass substrate 52, not on the side of the second glass substrate 55. Accordingly, a configuration similar to the liquid crystal display device of IPS (In-Plane-Switching) mode may be possible.

The backlight 63 has a light-guide/light-diffusing plate 631 and an LED array 632, and is located at a rear side of the polarizing film 56 (the lower side of the figure). In the LED array 632, as shown in a perspective-projected view of FIG. 14, light-emitting diodes (LEDs) which emit lights having respective R (red), G (green) and B (blue) colors are arranged in this order repeatedly on the surface facing the light-guide/light-diffusing plate 631, and the light emitted by each LED is diffused on the upper surface side of the light-guide/light-diffusing plate 631. The LEDs of respective RGB colors are controlled by the lighting drive control unit 64 to perform time-division light emission at a predetermined period. The light-guide/light-diffusing plate 631 can be divided into a light-guide plate and a light-diffusing plate.

The liquid crystal display device with the above configuration is capable of performing desired display by making each of the LEDs of the backlight 63 sequentially emit light by the lighting drive control unit 64, and in synchronization therewith, switching the TFTs 58 by the display drive control unit 57. An example of this operation will be described with reference to a timing chart shown in FIG. 15.

As shown in FIG. 15(*a*), a single field period is divided into three sub-field periods, and each TFT is switched to apply a voltage to each pixel electrode, thus driving the liquid crystal sandwiched between each pixel electrode and a counter electrode (hereinafter, to drive the liquid crystal in this way is referred to as "to write"). As shown in FIG. 15(*b*), after the writing in the first sub-field period is completed, the red LED emits light. Then, as shown in FIG. 15(*c*), the green LED emits light after the writing in the second sub-field period is completed, and as shown in FIG. 15(*d*), the blue LED emits light after the writing in the third sub-field period is completed. Thus, the light emission of RGB colors is repeated in each field period, which is the time-division light emission. Normally, the field period is 16.7 ms (1/60 sec).

According to the field sequential system like this, the effective transmittance of the backlight is improved in comparison with a conventional method employing a color filter, and the power consumption of the backlight can be reduced to 1/3 to 1/4. However, since the light emission intensity is different among the LEDs of respective colors, it becomes necessary to modulate the chromaticity of display colors. In the above-described publication, a method of chromaticity modulation for display colors by making the light emission time for each color different is disclosed.

Conventionally, however, it has been difficult to obtain good white display because the method of modulating the light emission time of each color was not determined and only empirical rules or trial-and-error methods could be counted on. For example, since the light emission intensity of the red LED has been conventionally considered to be lower than those of the green LED and the blue LED, the above-mentioned publication shows that the white display is performed by making the light emission time of the red LED (8.33 ms) longer than those of the green and blue LEDs (4.17 ms). However, even if the LEDs of respective colors actually emit light for the above-described time, it is difficult to perform desirable chromaticity modulation, and there is still plenty of room for improvement in setting the light emission time of LEDs of respective colors.

SUMMARY OF THE INVENTION

The present invention has been developed to solve the above-described problems, and its object is to provide a liquid crystal display device and a manufacturing method thereof, and a drive control method of a lighting unit which are capable of performing chromaticity modulation of display colors.

The above-described object is achieved by a liquid crystal display device comprising: a liquid crystal display panel having a first substrate, a second substrate, a liquid crystal sandwiched between the first substrate and the second substrate, plural pixel electrodes arranged in a matrix on the second substrate, a counter electrode provided on one of the first substrate and the second substrate and plural switching elements connected to the respective plural pixel electrodes; a display drive control unit for driving the liquid crystal sandwiched between each of the pixel electrodes and the counter electrode by switching each of the switching elements to apply a voltage to each of the pixel electrodes; a lighting unit having LEDs emitting light of respective red, green and blue colors, and applying the light of each color toward the liquid crystal display panel; and a lighting drive control unit for making the LED of each color perform time-division light emission in synchronization with the switching of each of the switching elements, wherein the LED of each color emits light in a pulse form at a predetermined duty ratio and any of the duty ratio of the LED of each color is not more than 50%, and wherein the light emission time of the LED emitting light of red color is set to be shorter than the light emission time of LED emitting light of green color and shorter than the light emission time of LED emitting light of blue color.

In the liquid crystal display device, it is preferred that the light emission time of the LED of red color is not more than about one-third of the light emission time of LED of green color and not more than about one-third of the light emission time of LED of blue color.

It is also preferred that the lighting drive control unit comprises a storage unit for storing a light emission time of each color in one field period, and makes the LED of each color emit light based on the light emission time.

It is also preferred that the LED of red color is formed by a semiconductor material made of GaAlAs and the LEDs of green and blue colors are formed by a semiconductor material made of GaN.

It is also preferred that, in each of sub-field periods obtained by dividing the field period by the number of the light colors, the LED of at least one color among the LEDs of respective colors starts to emit light after the completion of writing to the pixel electrodes.

The above-described object of the present invention is also achieved by a method of manufacturing a liquid crystal display device including: a liquid crystal display panel having a first substrate, a second substrate, a liquid crystal sandwiched between the first substrate and the second substrate, plural pixel electrodes arranged in a matrix on the second substrate, a counter electrode provided on one of the first substrate and the second substrate and plural switching elements connected to the respective plural pixel electrodes; a display drive control unit for driving the liquid crystal sandwiched between each of the pixel electrodes and the counter electrode by switching each of the switching elements to apply a voltage to each of the pixel electrodes; a lighting unit having LEDs emitting light of respective red, green and blue colors, and applying the light of each color toward the liquid crystal display panel; and a lighting drive control unit for making the LED of each color perform time-division light emission in synchronization with the switching of each of the switching elements, wherein the lighting drive control unit has a storage unit for storing a light emission time of each color in one field period, and makes the LED of each color emit light based on the light emission time, and wherein the light emission time of the LED emitting light of red color is set to be shorter than the light emission time of LED emitting light of green color and shorter than the light emission time of LED emitting light of blue color, and the method comprises: a step of making each of the LEDs of red, green and blue colors perform time-division light emission with a maximum power for a same predetermined time; a step of measuring chromaticity by the time-division light emission; a step of determining a low efficiency color having the lowest light emission efficiency based on the measured chromaticity; a step of determining light emission time of the low efficiency color to be equal to said predetermined time and determining light emission time of two colors other than the low efficiency color to be shorter than the predetermined time; and a step of storing the light emission time of the low efficiency color and the light emission time of the two colors in the storage unit.

In the method of manufacturing the liquid crystal display device, the step of determining the low efficiency color may comprise a step of comparing each individual chromaticity when each of the LEDs emits light individually with composite chromaticity when the time-division light emission is performed, and determining a color corresponding to a chromaticity point of the individual chromaticity which has the longest distance from a chromaticity point of the composite chromaticity on a chromaticity diagram as the low efficiency color.

The step of determining the light emission time may comprise a step of comparing standard chromaticity for obtaining good white display with composite chromaticity when the time-division light emission is performed, and determining the light emission time of two colors other than the low efficiency color from a positional relation between a chromaticity point of the standard chromaticity and that of the composite chromaticity on a chromaticity diagram.

The above-described object of the present invention is also achieved by a method of controlling a drive of a lighting unit including LEDs emitting light of respective red, green and blue colors, and the method comprises: a step of making the LED of each color perform time-division light emission with a maximum power for the same predetermined time; a step of measuring chromaticity by the time-division light emission; a step of determining a low efficiency color having the lowest light emission efficiency based on the measured chromaticity; and a step of making the LED of the low efficiency color emit light with a maximum power and making the LEDs of two colors other than the low efficiency color emit light with a reduced power.

In the method of controlling a drive of a lighting unit, it is preferred that the step of making the LED emit light comprises a step of determining light emission time of said low efficiency color to be equal to said predetermined time and determining light emission time of two colors other than the low efficiency color to be shorter than the predetermined time, and a step of making the LED of each color perform time-division light emission for the determined light emission time in one field period.

The above-described object of the present invention is also achieved by a liquid crystal display device comprising: a liquid crystal display panel having a first substrate, a second substrate, a liquid crystal sandwiched between the first substrate and the second substrate, plural pixel electrodes arranged in a matrix on the second substrate, a counter electrode provided on one of the first substrate and the second substrate and plural switching elements connected to the respective plural pixel electrodes; a display drive control unit for driving the liquid crystal sandwiched between each of the pixel electrodes and the counter electrode by switching each of the switching elements to apply a voltage to each of the pixel electrodes; a lighting unit having LEDs emitting light of respective red, green and blue colors, and applying the light of each color toward the liquid crystal display panel; and a lighting drive control unit for making the LED of each color perform time-division light emission in synchronization with the switching of each of the switching elements, wherein the lighting drive control unit comprises a light emission control switch capable of individually controlling a value of electric current flowing in the LED of each color, and wherein, in the light emission control switch, plural resistance modulation elements are connected in parallel, each of which shows an intrinsic resistance value by application of a predetermined voltage to a control terminal thereof.

In the liquid crystal display device, it is preferred that the lighting drive control unit further comprises a storage unit for storing control code for each color of light, the control code identifying one or plural resistance modulation elements, to the control terminal of which the predetermined voltage is applied, and makes the LED of each color emit light by the value of electric current based on the control code.

In the light emission control switch, a conductive line to one or plural resistance modulation elements selected for each color of light in advance may be physically cut, and in this case, the lighting drive control unit can apply the predetermined voltage to the control terminals of all of the resistance modulation elements.

It is preferred that a resistance value of each of the plural resistance modulation elements is set so that its relative ratio based on the lowest resistance value becomes a power of 2.

It is preferred that the lighting drive control unit controls so that the electric current flowing in the LED of red color is minimized.

The above-described object of the present invention is also achieved by a method of manufacturing a liquid crystal display device including: a liquid crystal display panel having a first substrate, a second substrate, a liquid crystal sandwiched between the first substrate and the second substrate, plural pixel electrodes arranged in a matrix on the second substrate, a counter electrode provided on one of the first substrate and the second substrate and plural switching elements connected to the respective plural pixel electrodes; a display drive control unit for driving the liquid crystal sandwiched between each of the pixel electrodes and the counter electrode by switching each of the switching elements to apply a voltage to each of the pixel electrodes; a lighting unit having LEDs emitting light of respective red, green and blue colors, and applying the light of each color toward the liquid crystal display panel; and a lighting drive control unit for making the LED of each color perform time-division light emission in synchronization with the switching of each of the switching elements, wherein the lighting drive control unit comprises a light emission control switch capable of individually controlling a value of electric current flowing in the LED of each color, and wherein, in the light emission control switch, plural resistance modulation elements are connected in parallel, each of which shows an intrinsic resistance value by application of a predetermined voltage to a control terminal thereof, and wherein the lighting drive control unit further comprises a storage unit for storing control code for each color of light, the control code identifying the one or plural resistance modulation elements, to the control terminal of which the predetermined voltage is applied, and the method comprises: a step of applying the predetermined voltage to the control terminals of all of the resistance modulation elements for making each of the LEDs of red, green and blue colors perform time-division light emission with a maximum power for a same predetermined time; a step of measuring chromaticity by the time-division light emission; a step of determining a low efficiency color having the lowest light emission efficiency from among the colors of red, green and blue based on the measured chromaticity; a step of determining control code for applying the predetermined voltage to the control terminals of all of the resistance modulation elements as the control code for the low efficiency color, and determining control code for two colors other than the low efficiency color so that the electric current flowing in the LEDs of the two colors is reduced; and a step of storing the control code for the low efficiency color and the control code for the two colors in the storage unit.

In the method of manufacturing a liquid crystal display device, the step of determining the low efficiency color may comprise a step of comparing each individual chromaticity when each of the LEDs of red, green and blue colors emits light individually with composite chromaticity when the time-division light emission is performed, and determining a color corresponding to a chromaticity point of the individual chromaticity which has the longest distance from a chromaticity point of the composite chromaticity on a chromaticity diagram as the low efficiency color.

The step of determining the control code may comprise a step of comparing standard chromaticity for obtaining good white display with composite chromaticity when the time-division light emission is performed, and determining the control code for two colors other than the low efficiency color from a positional relation between the standard chromaticity and the composite chromaticity on a chromaticity diagram.

The above-described object of the present invention is also achieved by a liquid crystal display device comprising: a liquid crystal display panel having a first substrate, a second substrate, a liquid crystal sandwiched between the first substrate and the second substrate, plural pixel electrodes arranged in a matrix on the second substrate, a counter electrode provided on one of the first substrate and the second substrate and plural switching elements connected to the respective plural pixel electrodes; a display drive control unit for driving the liquid crystal sandwiched between each of the pixel electrodes and the counter electrode by switching each of the switching elements to apply a voltage to each of the pixel electrodes; a lighting unit having LEDs emitting light of respective red, green and blue colors, and applying the light of each color toward the liquid crystal display panel; and a lighting drive control unit for making the LED of each color perform time-division light emission in synchronization with the switching of each of the switching elements, wherein the lighting drive control unit comprises a switching transformer which generates a drive voltage for the LED of each color at its secondary side based on a light emission control signal input to its primary side, and the switching transformer comprises a primary winding and a secondary winding at the primary side and the secondary side, respectively, the secondary winding comprising an output tap at some midpoint of the winding, and wherein at least one of the LEDs of respective colors is connected to an end portion of the secondary winding and one of remaining LEDs is connected to the output tap.

In the liquid crystal display device, it is preferred that the LED connected to the output tap is the LED of red color.

The above-described object of the present invention is also achieved by a liquid crystal display device comprising: a liquid crystal display panel having a first substrate, a second substrate, a liquid crystal sandwiched between the first substrate and the second substrate, plural pixel electrodes arranged in a matrix on the second substrate, a counter electrode provided on one of the first substrate and the second substrate and plural switching elements connected to the respective plural pixel electrodes; a display drive control unit for driving the liquid crystal sandwiched between each of the pixel electrodes and the counter electrode by switching each of the switching elements to apply a voltage to each of the pixel electrodes; a lighting unit having LEDs emitting light of respective red, green and blue colors, and applying the light of each color toward the liquid crystal display panel; and a lighting drive control unit for making the LED of each color perform time-division light emission in synchronization with the switching of each of the switching elements, wherein the lighting drive control unit comprises a pulse generator which generates a pulse signal having a desired pulse width and a switching transformer which generates a drive voltage for the LED of each color at its secondary side based on the pulse signal input to its primary side, and modulates the pulse width of the pulse signal for each of the LEDs of respective colors.

In the liquid crystal display device, it is preferred that the pulse width is modulated so that the drive voltage applied to the LED of red color becomes the lowest.

DETAILED DESCRIPTION OF THE PREFERRED EMBODIMENTS

Herein under preferred embodiments of the present invention will be described in accordance with the accompanying drawings.

First Embodiment

Figure 1:
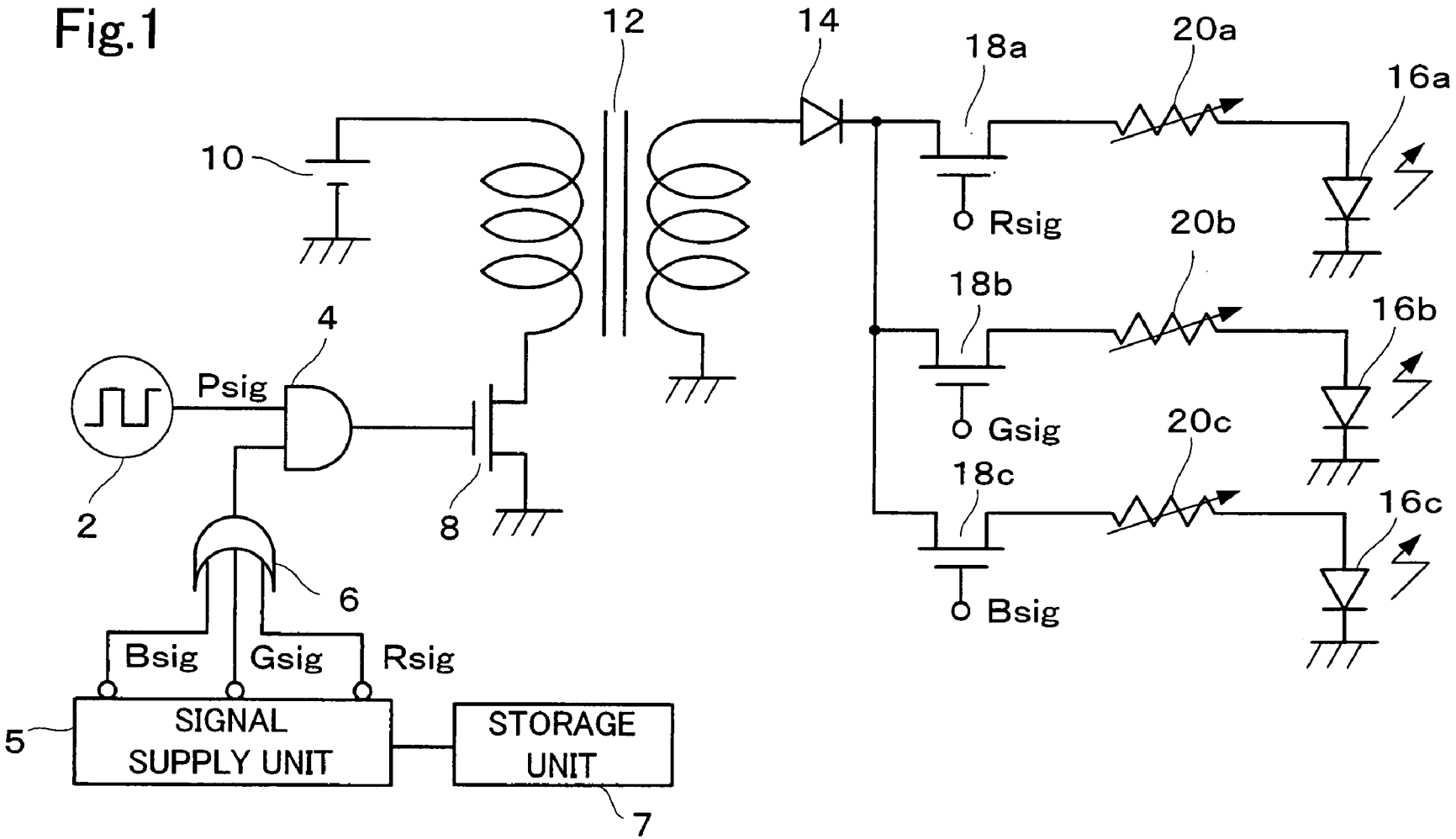
FIG. 1 is a circuit diagram of a lighting drive control unit in a liquid crystal display device according to a first embodiment of the present invention.

FIG. 1 is a circuit diagram of a lighting drive control unit in a liquid crystal display device of a field sequential system according to a first embodiment of the present invention. In this embodiment and the following embodiments, the configuration other than the lighting drive control unit is the same as the conventional configuration, and therefore, explanation will be omitted.

As shown in FIG. 1, the lighting drive control unit includes a switching transformer 12 having a primary winding and a secondary winding at a primary side and a secondary side, respectively. At the primary side of the switching transformer 12, a pulse generator 2, an AND gate 4, an OR gate 6, a switching transistor 8 and a direct-current power supply 10 are provided, and at the secondary side of the switching transformer 12, a rectifier diode 14, LEDs 16*a*, 16*b* and 16*c* of each of RGB colors, respectively, light emission control transistors 18*a*, 18*b* and 18*c*, and variable resistors 20*a*, 20*b* and 20*c* are provided.

The pulse generator 2 inputs a pulse signal Psig having a frequency of about 30 kHz to 100 kHz to the AND gate 4. To this AND gate 4, light emission control signals for RGB colors, Rsig, Gsig and Bsig supplied from a signal supply unit 5 are also input via the OR gate 6 which calculates OR operation of them. The light emission control signals Rsig, Gsig and Bsig are pulse signals, and light emission time information related to the pulse width (namely, the light emission time) of each of them is stored in a storage unit 7 such as EEPROM (Electrically Erasable Programmable Read-Only Memory) in advance.

The switching transistor 8 performs switching according to the input of a signal based on the result of AND operation between the pulse signal Ps and any of the light emission control signals Rsig, Gsig and Bsig to the gate. In response to the switching, an electric current flows at the primary side of the switching transformer 12 by the direct-current power supply 10.

To the end of the secondary winding at the secondary side of the switching transformer 12, the LEDs of respective RGB colors 16*a*, 16*b* and 16*c* of the backlight are connected in parallel via the rectifier diode 14. Between the rectifier diode 14 and the LEDs of respective colors 16*a*, 16*b* and 16*c*, the light emission control transistors 18*a*, 18*b* and 18*c* and the variable resistors 20*a*, 20*b* and 20*c* are located, respectively. To the gates of the light emission control transistor 18*a*, 18*b* and 18*c*, the corresponding light emission control signals Rsig, Gsig and Bsig are input, respectively. In FIG. 1, only one example is shown for each of the LEDs of respective colors 16*a*, 16*b* and 16*c*, but in practical cases, plural LEDs are provided for each color.

Figure 2:
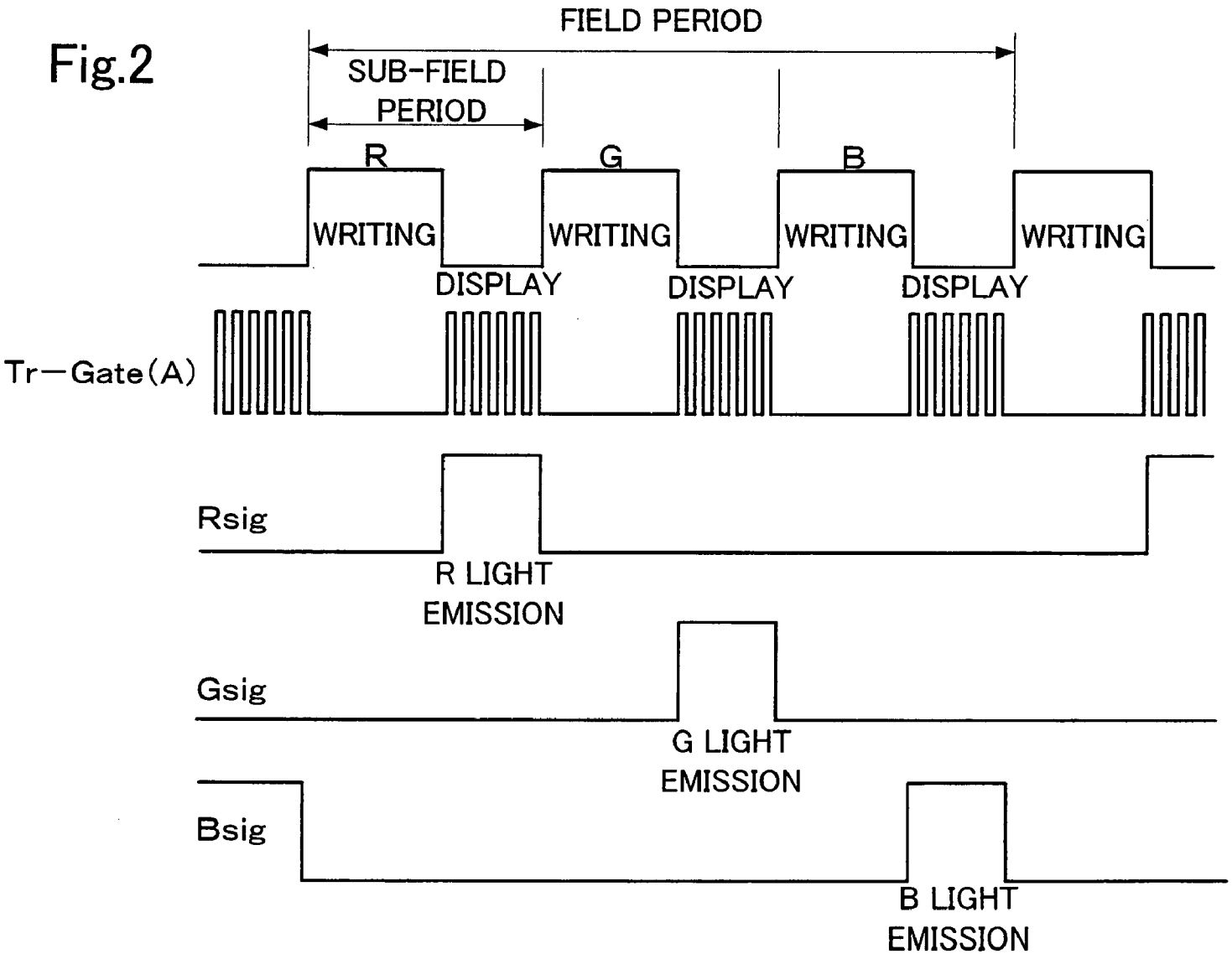
FIG. 2 is a timing chart showing an operation of the lighting drive control unit shown in FIG. 1.

According to the lighting drive control unit with the above configuration, based on the input of the light emission control signals Rsig, Gsig and Bsig from the signal supplying unit 5, any of the LEDs of respective colors 16*a* to 16*c* corresponding thereto emit light. The light emission control signals Rsig, Gsig and Bsig are input not only to the gates of the light emission control transistors 18*a* to 18*c*, but also to the AND gate 4 via the OR gate 6, and therefore, the switching transistor 8 is in ON state only during the period when the light emission control signals Rsig, Gsig and Bsig are input. Accordingly, during the writing period to the pixel electrode when the LEDs of respective colors 16*a* to 16*c* does not emit light, the electric current can be prevented from flowing to the secondary side of the switching transformer 12, thus capable of saving the power. In this embodiment, as shown in the timing chart of FIG. 2, the signal (Tr-Gate) input to the switching transistor 8 is a pulse signal.

The pulse widths of the light emission control signals Rsig, Gsig and Bsig can be modulated with ease by altering the light emission time information stored in the storage unit 7, whereby the emission time of the LED of each color can be set to a desired value.

As described above, in the liquid crystal display device of the field sequential system, the chromaticity modulation for display colors can be performed by making the light emission time of each color different from each other. Conventionally, the blue LED has been considered to have the highest light emission efficiency, and therefore, settings have been made to shorten the light emission time of the blue LED for achieving the chromaticity modulation.

However, the inventors of the present invention have found by experiment that a problem peculiar to the field sequential system arise in making settings of the light emission time of LEDs of respective colors of the backlight. That is, the LEDs of respective colors of the backlight do not emit light at all times, but emit light in a pulse form with a predetermined duty ratio in every sub-field generated by dividing one field by the number of colors of the LEDs. Accordingly, it is necessary to determine not only the absolute light emission intensity of the LEDs of respective colors in the state where the duty ratio is 100% (energized at all times), but also the effect of the duty ratio on the light emission intensity of LEDs of respective colors.

Figure 3:
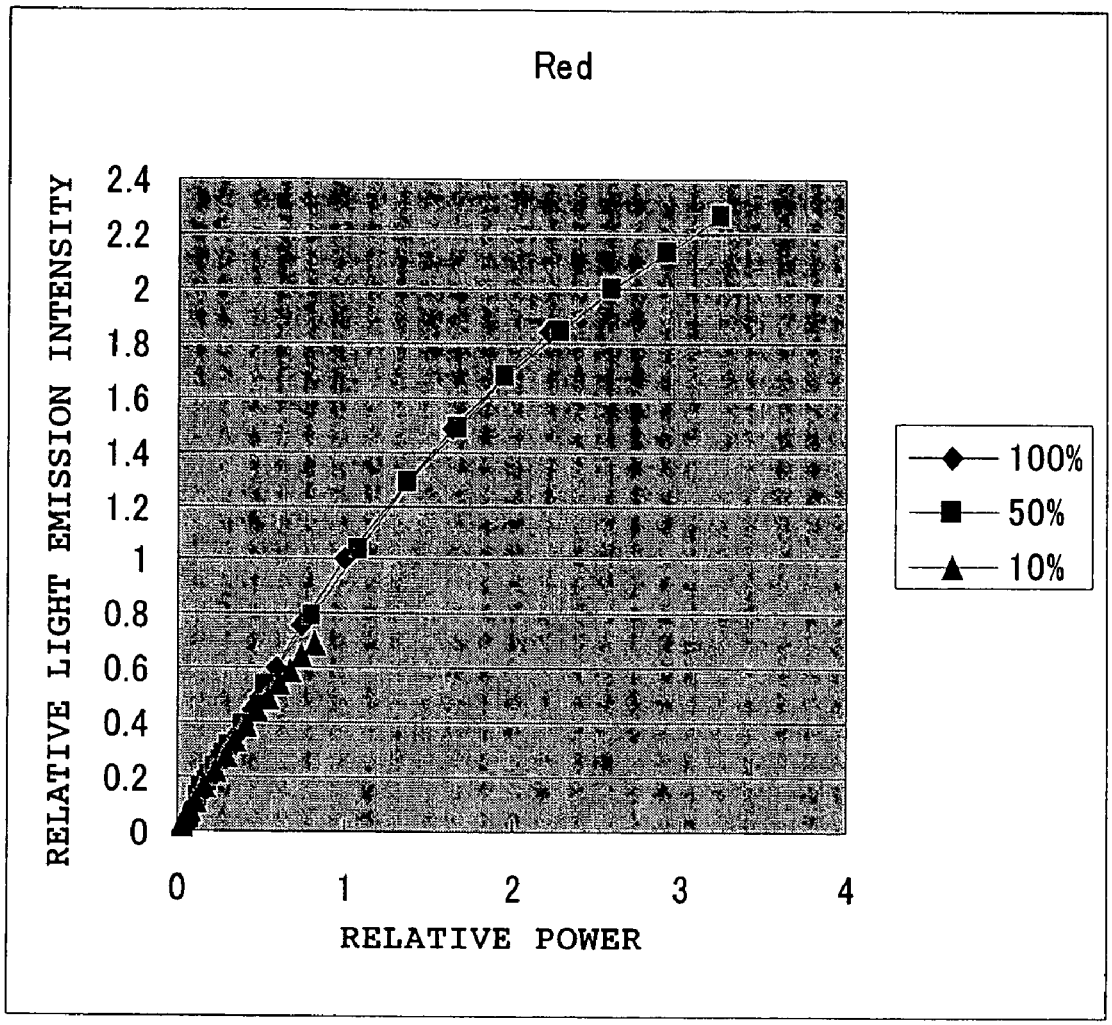
FIG. 3 is a view showing a relation between relative power and relative light-emitting intensity of a red LED.
Figure 4:
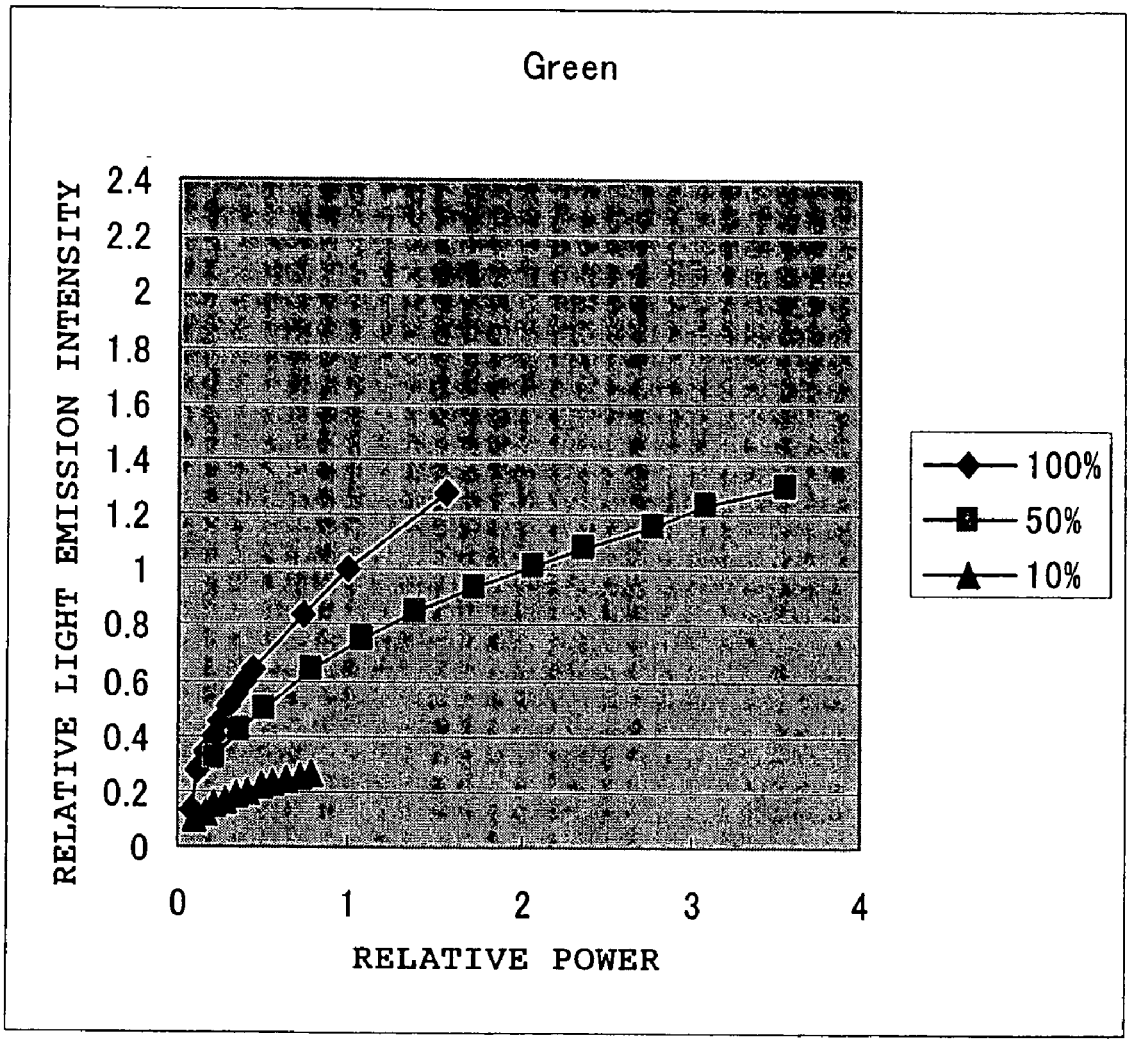
FIG. 4 is a view showing a relation between relative power and relative light-emitting intensity of a green LED.
Figure 5:
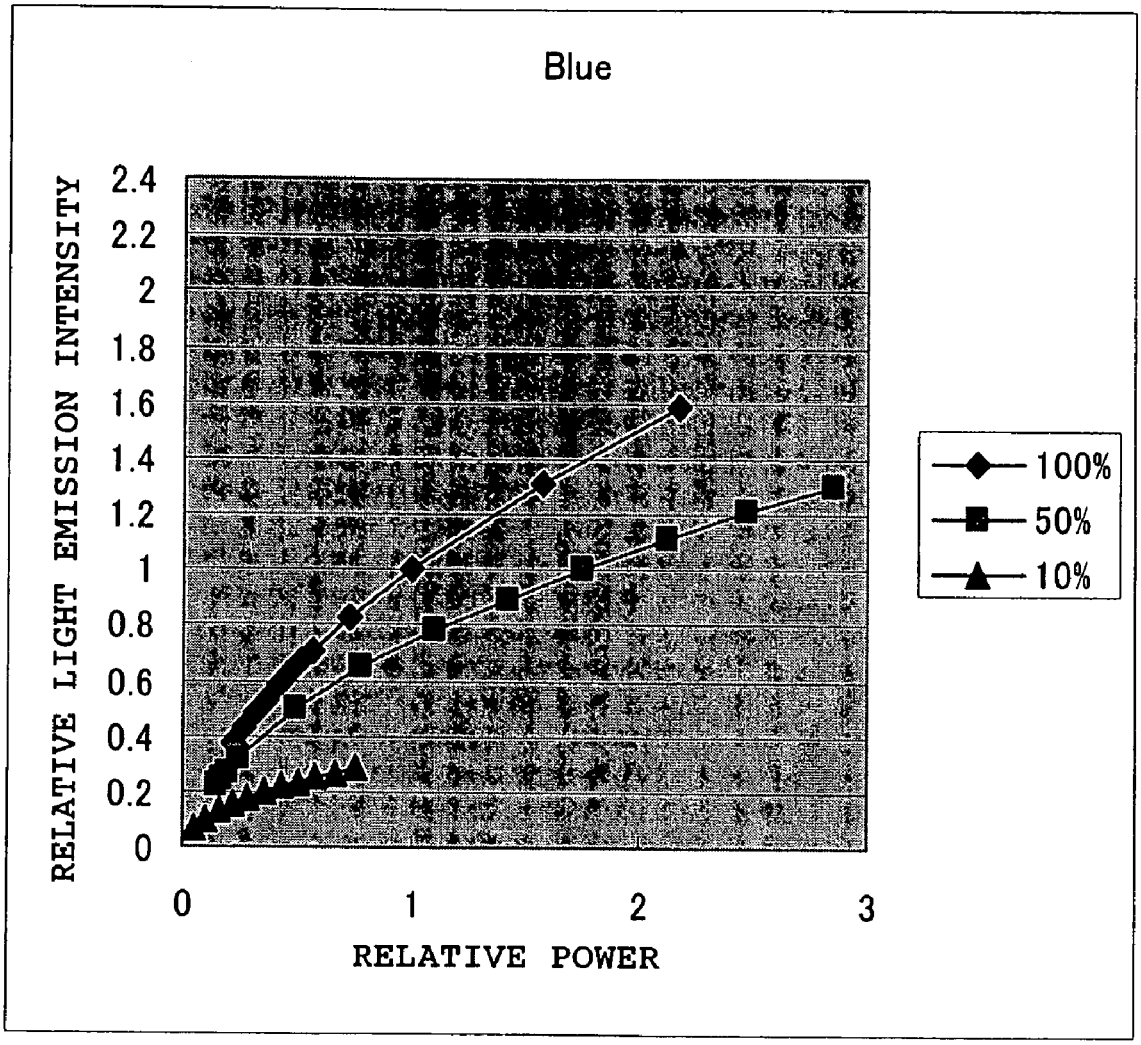
FIG. 5 is a view showing a relation between relative power and relative light-emitting intensity of a blue LED.

To that end, the relation between the relative power and the relative light emission intensity for the LEDs of respective RGB colors was measured, where the parameter was the duty ratio. The results are shown in FIGS. 3 to 5. FIG. 3 shows the measured result for the red LED, FIG. 4 shows the measured result for the green LED, and FIG. 5 shows the measured result for the blue LED. The relative light emission intensity and the relative power were measured with respect to the state where the duty ratio is 100%. GaAlAs (gallium, aluminum, arsenic) was employed as the semiconductor material of the red LED, and GaN (gallium nitride) was employed for the green and blue LEDs.

As shown in FIGS. 3 to 5, with regard to the red LED, the relative light emission intensity is rarely reduced even in the state where the duty ratio is 10% in comparison with the case where the duty ratio is 100%. On the contrary, with regard to the green and blue LEDs, if the duty ratio is lowered (the state where the duty ratio is 100% is changed to the state where it is 10%), the inventors of the present invention have found the fact that the relative light emission intensity is significantly reduced.

Accordingly, in the field sequential system in which the LEDs of respective RGB colors are made to emit pulse light, it becomes obvious that a high light emission efficiency is available by making the light emission time of the red LED shortest, the relative light emission intensity of which is rarely reduced even with a low duty ratio not more than 50%.

It is desirable that the duty ratio is not less than 10% because, if the duty ratio is less than 10%, the emission time of the LED is significantly shortened, and as a result, there occurs difficulty in forming images in some cases. Consequently, the desirable range of the duty ratio in the present invention is not less than 10% and not more than 50%.

In the lighting drive control unit shown in FIG. 1, under the settings that the number of LEDs of each color 16*a*, 16*b* and 16*c* is the same and that the value of the electric current per a single LED is set to 100 mA, the color temperature becomes about 6500° C. in the case where the ratio of the pulse widths of the light emission control signals Rsig, Gsig and Bsig (namely, the ratio of the lengths of light emission time) is about 1:3:1, thus realizing a good white display. This optimal ratio of the pulse widths varies depending on the light emission intensity of the LEDs of respective colors 16*a*, 16*b* and 16*c* and the above-mentioned electric current value, and there is a tendency that the higher the light emission intensity or the electric current value is, the larger the ratio of the pulse widths of the light emission control signals of green and blue Gsig and Bsig to the pulse width of the light emission control signal of red Rsig becomes.

Figure 6:
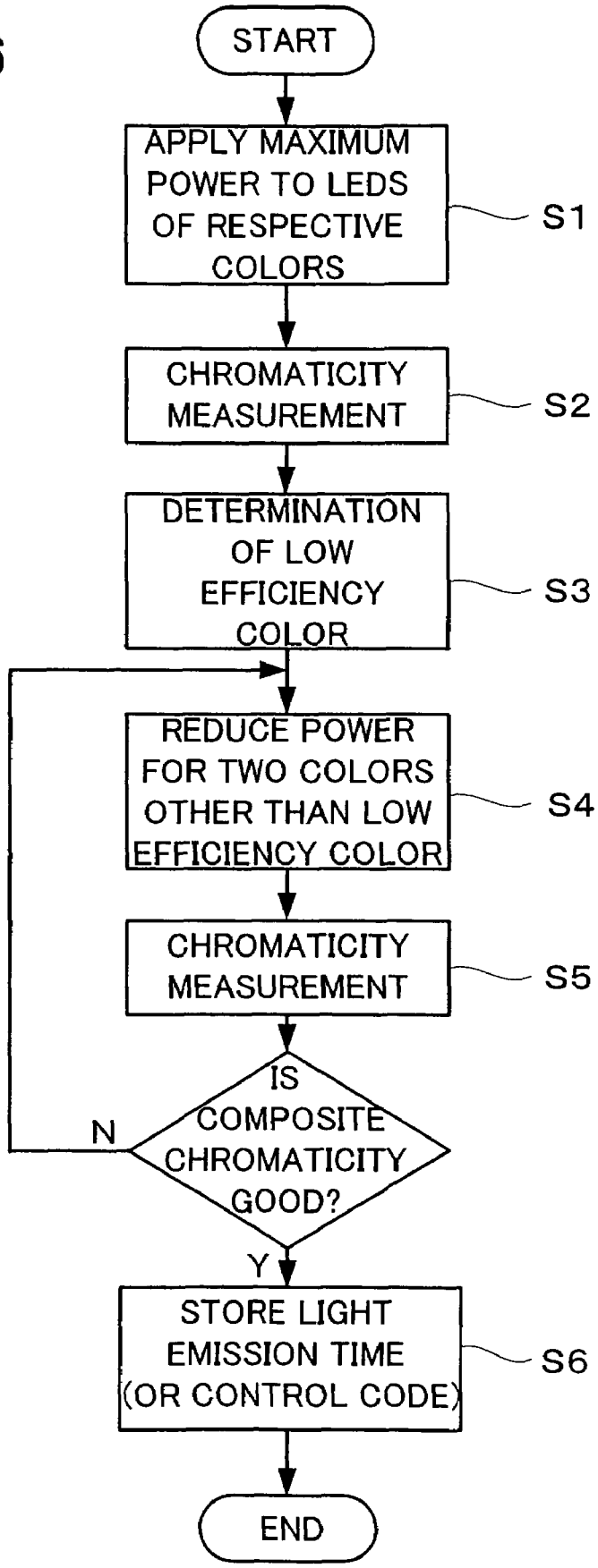
FIG. 6 is a flowchart showing a method of determining a light emission time of the LEDs of respective colors.

Next, a method of specifically determining the light emission time of the LEDs of respective RGB colors for performing good chromaticity modulation will be described. According to the measurement by the inventors of the present invention, even under the same conditions of the color and electric current value, the light emission intensity has variations within a range of ±40%. Therefore, it is difficult to make standardized determination of light emission time of the LED of each color and it is required to make product-by-product determination with good efficiency. This determination method will be explained with reference to the flowchart shown in FIG. 6.

To begin with, the LEDs of respective RGB colors are subjected to time-division light emission for the same predetermined time by maximum power (step Si). The predetermined time may be, for example, the longest time after the completion of writing in each sub-field period, thus enabling the LED of each color emit light with maximum light emission intensity.

Figure 7:
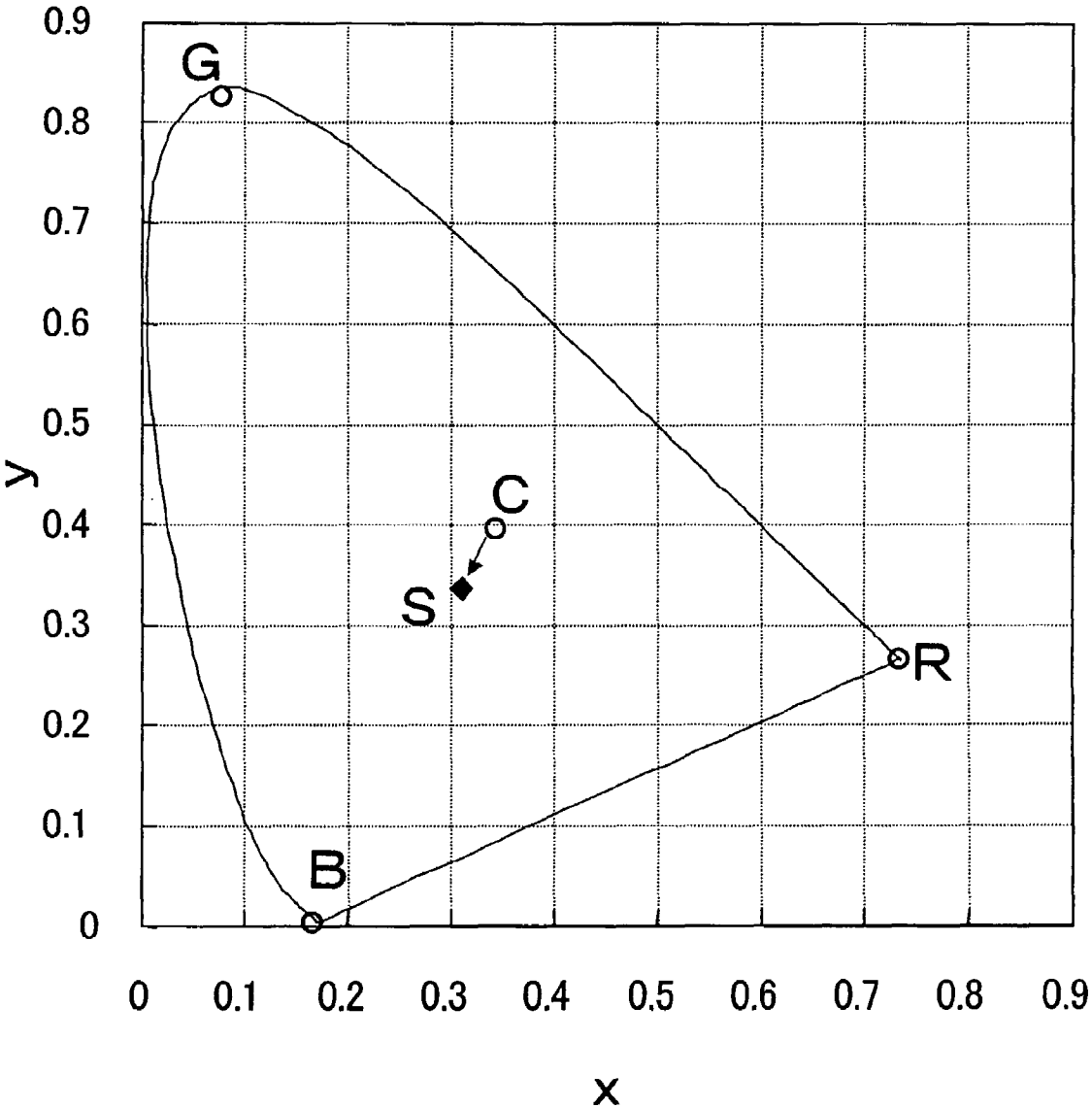
FIG. 7 is a chromaticity diagram illustrating colors displayed by LEDs of respective colors.

Next, the chromaticity in the time-division light emission is measured by using a color meter (step S2). Then, based on the result of the measurement, a low-efficiency color having the lowest light emission efficiency with respect to the power consumption is determined (step S3). In other words, in the chromaticity diagram shown in FIG. 7, the distance between a composite chromaticity point C obtained by composing each of RGB colors for which light emission is performed by the maximum power and each of individual chromaticity points R, G and B obtained by making the LEDs of respective RGB colors emit light individually is calculated, and the low-efficiency color corresponding to an individual chromaticity point having the longest distance from the composite chromaticity point C is determined. In FIG. 7, the distance between the composite chromaticity point C and the individual chromaticity point B is the longest, and therefore, the low-efficiency color is blue. After that, the light emission time of the low-efficiency color is determined to be equal to the predetermined time.

Next, the power used for two colors other than the low-efficiency color is reduced (step S4). That is, in FIG. 7, each of the distances traveled by the chromaticity points of red and green is calculated based on the distance between the measured composite chromaticity point C and a standard chromaticity point S at the color temperature of 6500° C., and the light emission time of LED of each of red and green is determined on the basis of the relation between the distance traveled and the light emission time stored in advance in a storage unit such as EEPROM. In general, it is necessary to shorten the light emission time as the distance traveled becomes longer. When determining the relation between the distance traveled and the light emission time, it is desirable to take it into account that, with respect to the LED of green or blue, there are some cases where the relative light emission intensity is significantly reduced if the light emission time is shortened as described above. The standard chromaticity point S can be a point at the color temperature other than 6500° C.

The LED of each color is made to emit light again for light emission time for each of RGB colors thus determined, and the chromaticity is measured (step S5). If the deviation of the newly measured composite chromaticity point from the standard chromaticity point S is not within the allowable range, the process of step S4 and those subsequent thereto described above are repeated to finally determine the light emission time of the LED of each color, and the determined light emission time is stored in the storage unit such as EEPROM (step S6). According to such a method, even if there are variations in light emission efficiency of the LED, it becomes possible to perform good chromaticity modulation while maintaining the light emission intensity of the LED of each color high as far as possible.

Second Embodiment

Figure 8:
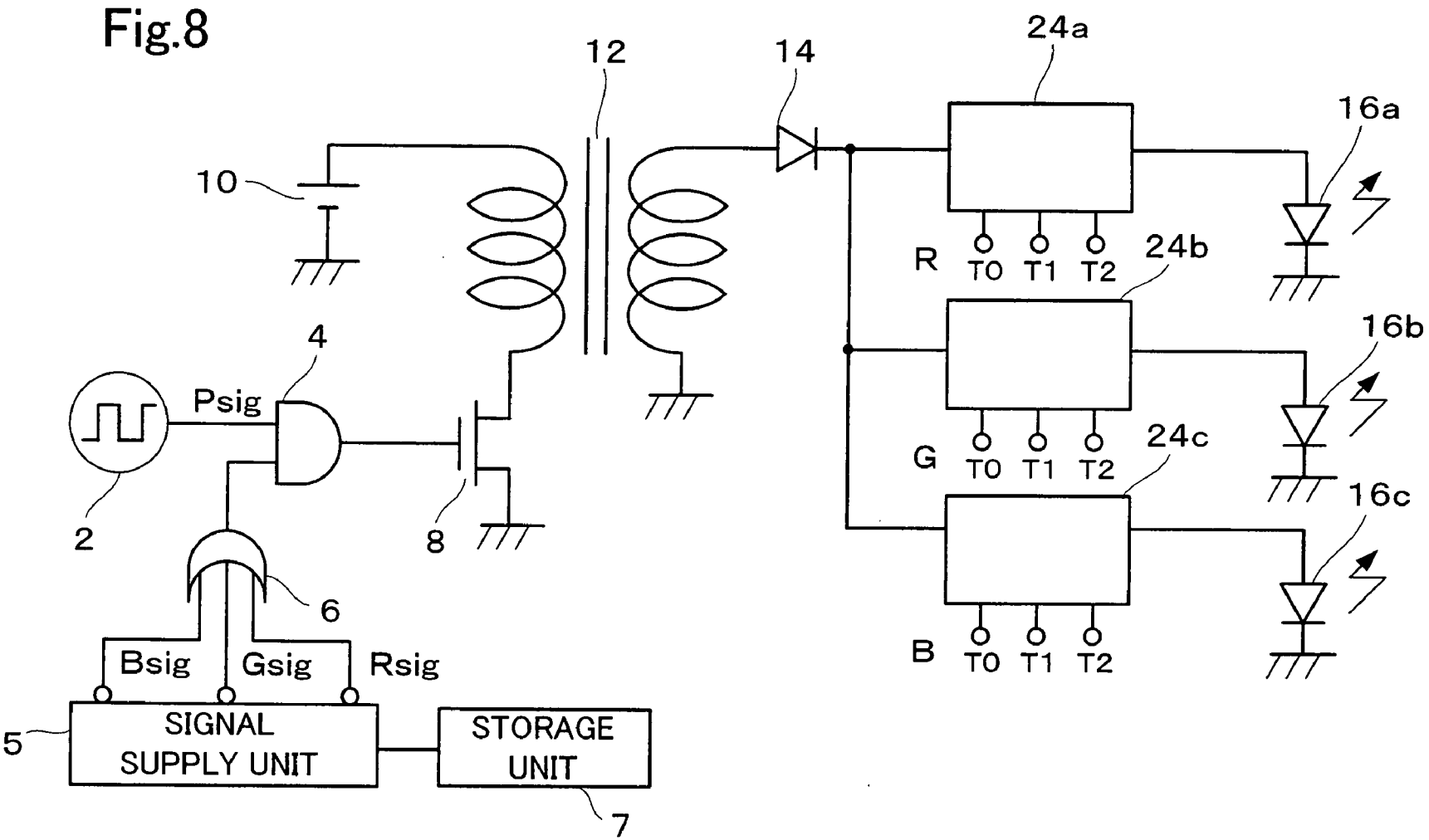
FIG. 8 is a circuit diagram of a lighting drive control unit in a liquid crystal display device according to a second embodiment of the present invention.

FIG. 8 is a circuit diagram of a lighting drive control unit in the liquid crystal display device of the field sequential system according to the second embodiment of the present invention. The lighting drive control unit shown in the figure has a configuration including light emission control switches 24*a*, 24*b* and 24*c* between the rectifier diode 14 and the LEDs of respective colors 16*a*, 16*b* and 16*c*, respectively, instead of the light emission control transistors 18*a* to 18*c* and the variable resistors 20*a* to 20*c* of the lighting drive control unit in the first embodiment shown in FIG. 1. Since the other constituents are the same as those of the first embodiment, they have the same reference numerals as those of the first embodiment and the explanation will be omitted.

Figure 9:
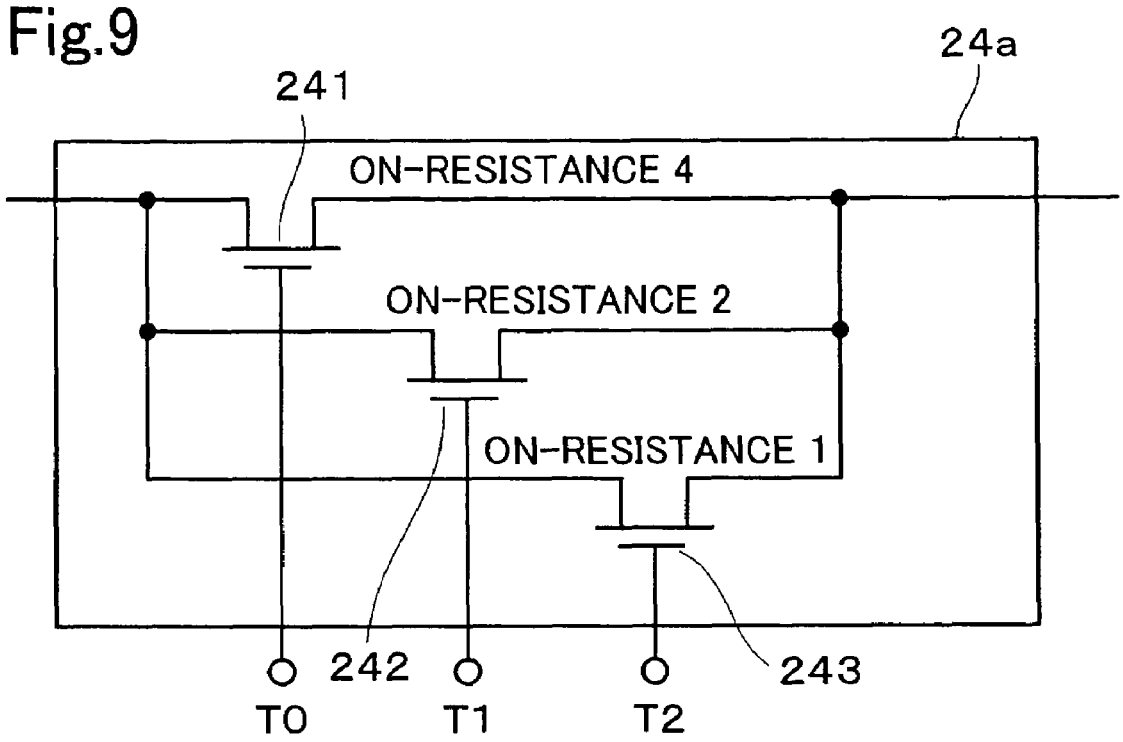
FIG. 9 is a view showing a detailed structure of a light emission control switch in the lighting drive control unit shown in FIG. 8.

A detailed structure of the light emission control switches 24*a* to 24*c* is shown in FIG. 9. FIG. 9 shows only the light emission control switch 24*a*, but the same holds true for the light emission control switches 24*b* and 24*c*.

As shown in FIG. 9, in the light emission control switch 24*a*, three transistors 241, 242 and 243 are connected in parallel as resistance modulation elements, and their settings are made so that the ratio of the relative values of their on-resistance becomes 4:2:1. A voltage is applied to control terminals TO, T1 and T2 of the respective transistors 241, 242 and 243 in accordance with control code stored in advance in the storage unit such as EEPROM.

The control code identifies the control terminals TO, T1 and T2 to which the voltage is applied, defining the voltage applied to the LED, and it is individually determined for each of the light emission control switches 24*a* to 24*c*. Hereinafter, it is assumed that the LED having the highest light emission efficiency is 16*a* and that the LEDs 16*b* and 16*c* have the lower light emission efficiency than the LED 16*a* for simplifying the explanation. By setting the control code so that the voltage is applied only to the control terminal TO, the light emission control switch 24*a* connected with the LED 16*a* having the highest light emission efficiency makes only the transistor 241 having the highest on-resistance ON state and the other transistors 242 and 243 OFF state. On the other hand, the light emission control switches 24*b* and 24*c* connected with the respective LEDs 16*b* and 16*c* having low light emission efficiency set the control code so that the voltage is applied to all of the control terminals T0 to T2, thus making all of the transistors 241 to 243 ON state.

According to the above-described control, the resistance value is changed corresponding to the light emission efficiency of the LEDs 16*a* to 16*c* to adjust the electric current value of each of the LEDs 16*a* to 16*c*, whereby the chromaticity modulation can be well performed.

Next, the method of specifically determining the control code for performing good chromaticity modulation will be explained. The basic flow is as same as the first embodiment; therefore, the method will be described with reference to the flowchart shown in FIG. 6.

At first, the LED of each of RGB colors is subjected to time-division light emission for the same predetermined time by maximum power (step Si). In other words, for all of the light emission control switches 24*a* to 24*c*, each of the transistors 241 to 243 is made ON state by applying the voltage to all of the control terminals T0 to T2. As is the case of the first embodiment, the predetermined time may be the maximum time after the completion of writing in each sub-field period.

Then the chromaticity in this case is measured by using a color meter (step S2). Based on the result of measurement, a low-efficiency color which has the lowest light emission efficiency for power consumption is determined (step S3). This method of determination is as same as the first embodiment. If, as shown in FIG. 7, the light emission efficiency of the blue LED 16*c* is the lowest, the control code is set so that the voltage is applied to all of the control terminals T0 to T2 with respect to the light emission control switch 24*c* corresponding to the blue LED 16*c*.

Next, the power for two colors other than the low-efficiency color is reduced (step S4). That is, in FIG. 7, each of the distances traveled by the chromaticity points of red and green is calculated based on the distance between the composite chromaticity point C and the standard chromaticity point S at the color temperature of 6500° C., and the control code for red and green is determined on the basis of the relation between the distance traveled and the control code stored in advance in a storage unit such as EEPROM. In general, the control code may be determined so that the electric current value of the LED is smaller as the distance traveled becomes longer.

The LED of each color is made to emit light again in accordance with the control code for each of RGB colors thus determined, and the chromaticity is measured (step S5). If the deviation of the newly measured composite chromaticity point from the standard chromaticity point S is not within the allowable range, the process of step S4 and those subsequent thereto described above are repeated to finally determine the control code and store it in the storage unit such as EEPROM (step S6). According to such a method, even if there are variations in light emission efficiency of the LED, it becomes possible to perform good chromaticity modulation while maintaining the light emission intensity of the LED of each color high as far as possible.

In this embodiment, the control code is stored in the storage unit. However, instead of this, all of the control terminals T0 to T2 may be applied the voltage by cutting the drain side or the source side of one or plurality of the transistors 241 to 243 beforehand by laser-cutting or the like, which is/are made OFF state according to the control code. In this case, the same effect as this embodiment can be obtained without storing the control code.

In this embodiment, number of the transistors held by each of the light emission control switches 24*a* to 24*c* is three. However, there is no limitation as long as there are plural transistors. It is desirable that the relative value of on-resistance of each transistor is different with one another. By determining the transistor size (in general, the gate width) so that the relative ratio based on the lowest r esistance value includes the power of 2, for example, 1:2:4:8: . . . , the chromaticity modulation in a wide range can be finely performed.

Third Embodiment

Figure 10:
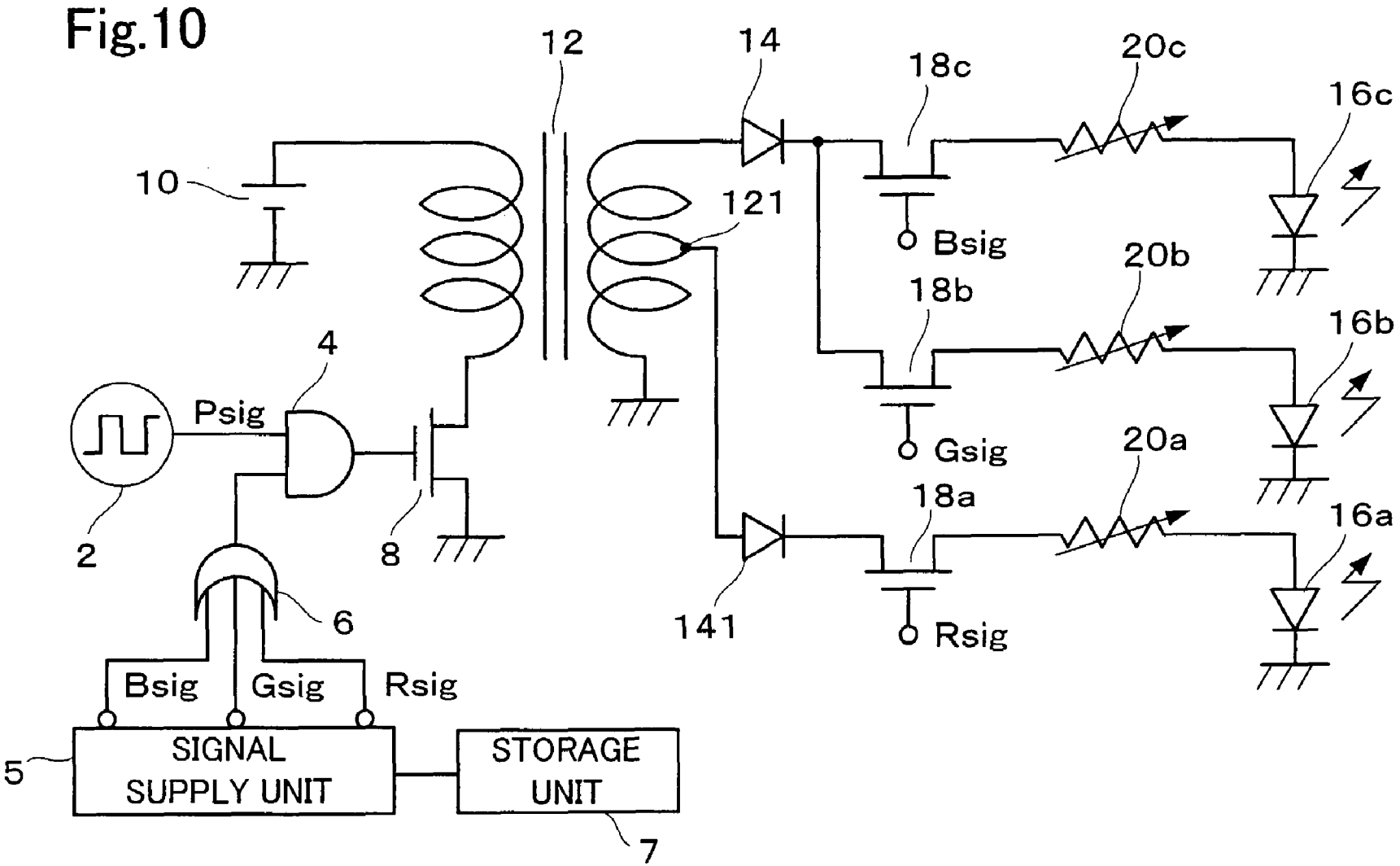
FIG. 10 is a circuit diagram of a lighting drive control unit in a liquid crystal display device according to a third embodiment of the present invention.

FIG. 10 is a circuit diagram of a lighting drive control unit in the liquid crystal display device of the field sequential system according to the third embodiment of the present invention. In the first embodiment shown in FIG. 1, the downstream side of the rectifier diode 14 connected to the secondary winding of the switching transformer 12 branches off to be connected to the LEDs of each color 16*a*, 16*b* and 16*c*. On the other hand, in this embodiment, instead of branching the downstream side of the rectifier diode 14, a tap 121 is drawn from some midpoint of the secondary winding of the switching transformer 12 and connected to the red LED 16*a* via the light emission control transistor 18*a* and the variable resistor 20*a*. Between the tap 121 and the light emission control transistor 18*a*, a new rectifier diode 141 is provided. The other constituents are as same as those of the first embodiment; therefore, the same constituents have the same reference numerals, and explanation will be omitted.

According to such a control circuit, the voltage applied to the red LED 16*a* becomes lower than those applied to the green and blue LEDs 16*b* and 16*c*. As explained in the first embodiment, in the field sequential system in which the LED of each color carries out pulse light emission, decrease of the light emission intensity of the red LED at a low duty ratio is less than those of the green and blue LEDs. Therefore, by making only the voltage applied to the red LED low, good white display becomes available. Adjustment of the voltage applied to the red LED 16*a* for performing chromaticity modulation of the display color can be carried out by providing plural taps 121 in advance and changing their positions appropriately, and accordingly, it is unnecessary to perform adjustment using the variable resistor 20*a*. Consequently, loss of the power can be reduced by lowering the resisting values of the variable resistors 20*a* to 20*c*.

Fourth Embodiment

Figure 11:
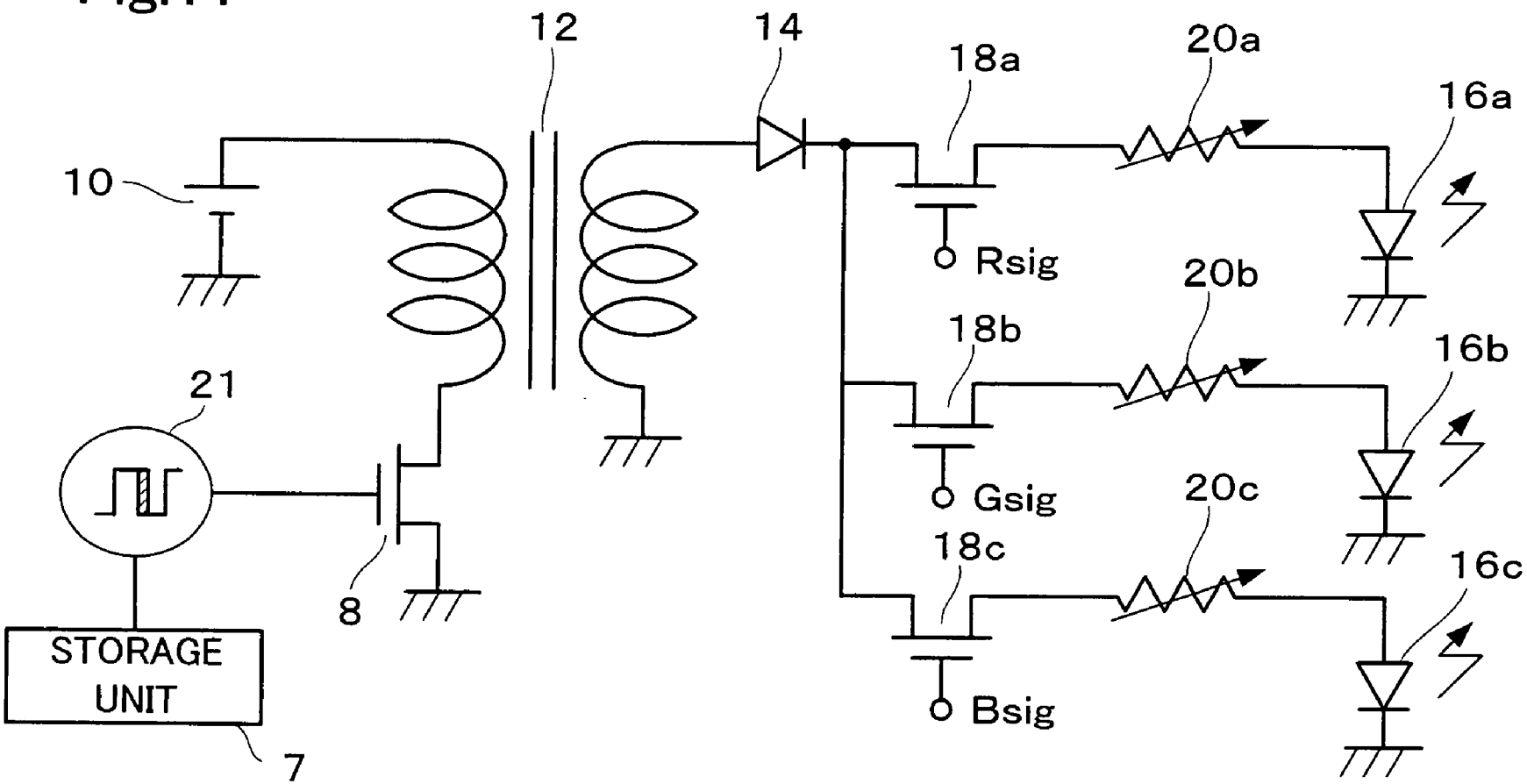
FIG. 11 is a circuit diagram of a lighting drive control unit in a liquid crystal display device according to a fourth embodiment of the present invention.

FIG. 11 shows a circuit diagram of a lighting drive control unit in a liquid crystal display device of the field sequential system according to the fourth embodiment of the present invention. In this embodiment, a pulse generator 21 capable of modulating pulse width is directly connected to the gate of the switching transistor 8. A storage unit 71 for storing a duty ratio of a pulse signal is connected to the pulse generator 21. Since other constituents are the same as those of the first embodiment, they have the same reference numerals as the first embodiment, and explanation will be omitted.

Figure 12:
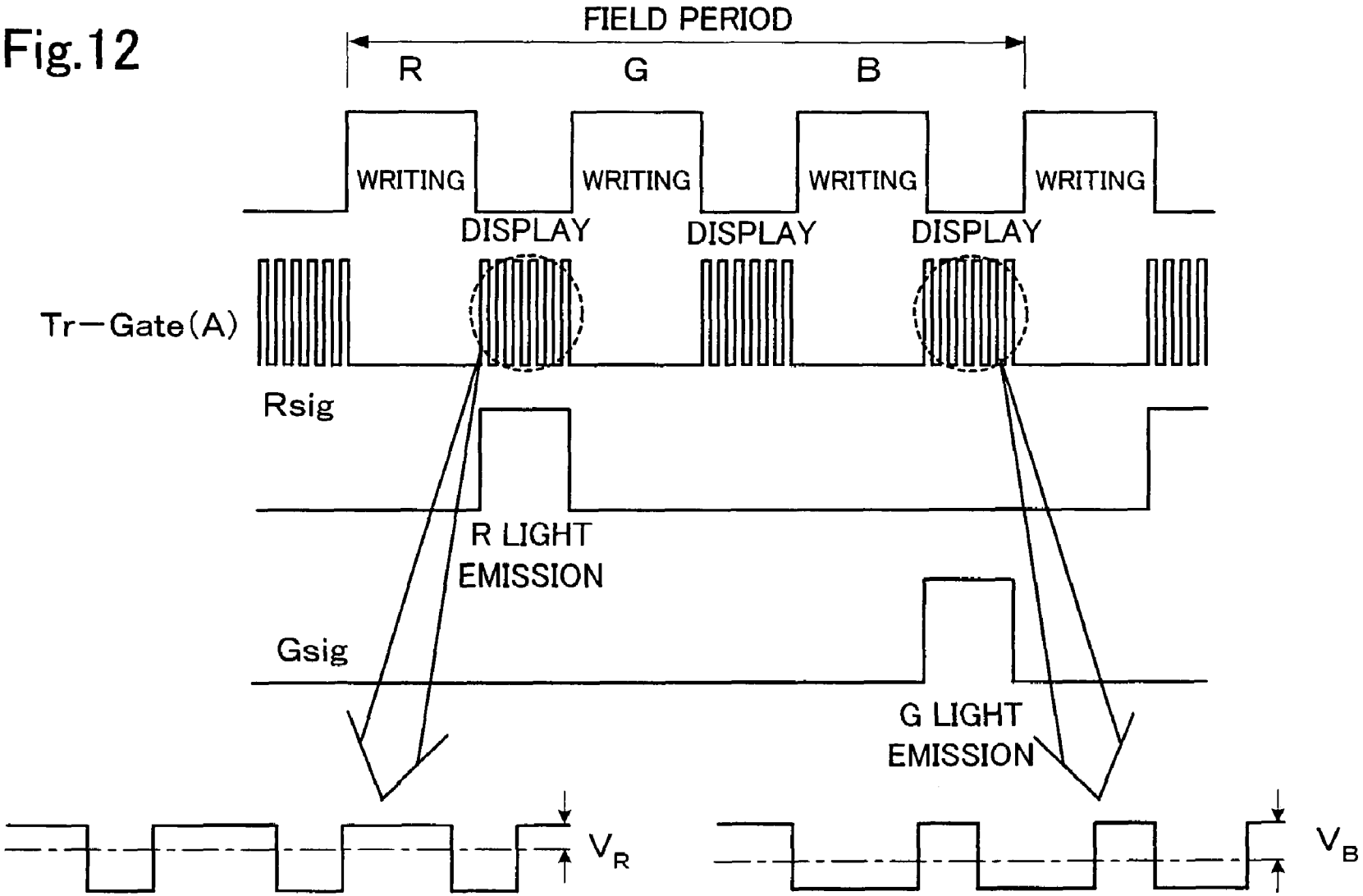
FIG. 12 is a timing chart showing an operation of the lighting drive control unit shown in FIG. 11.
Figure 13:
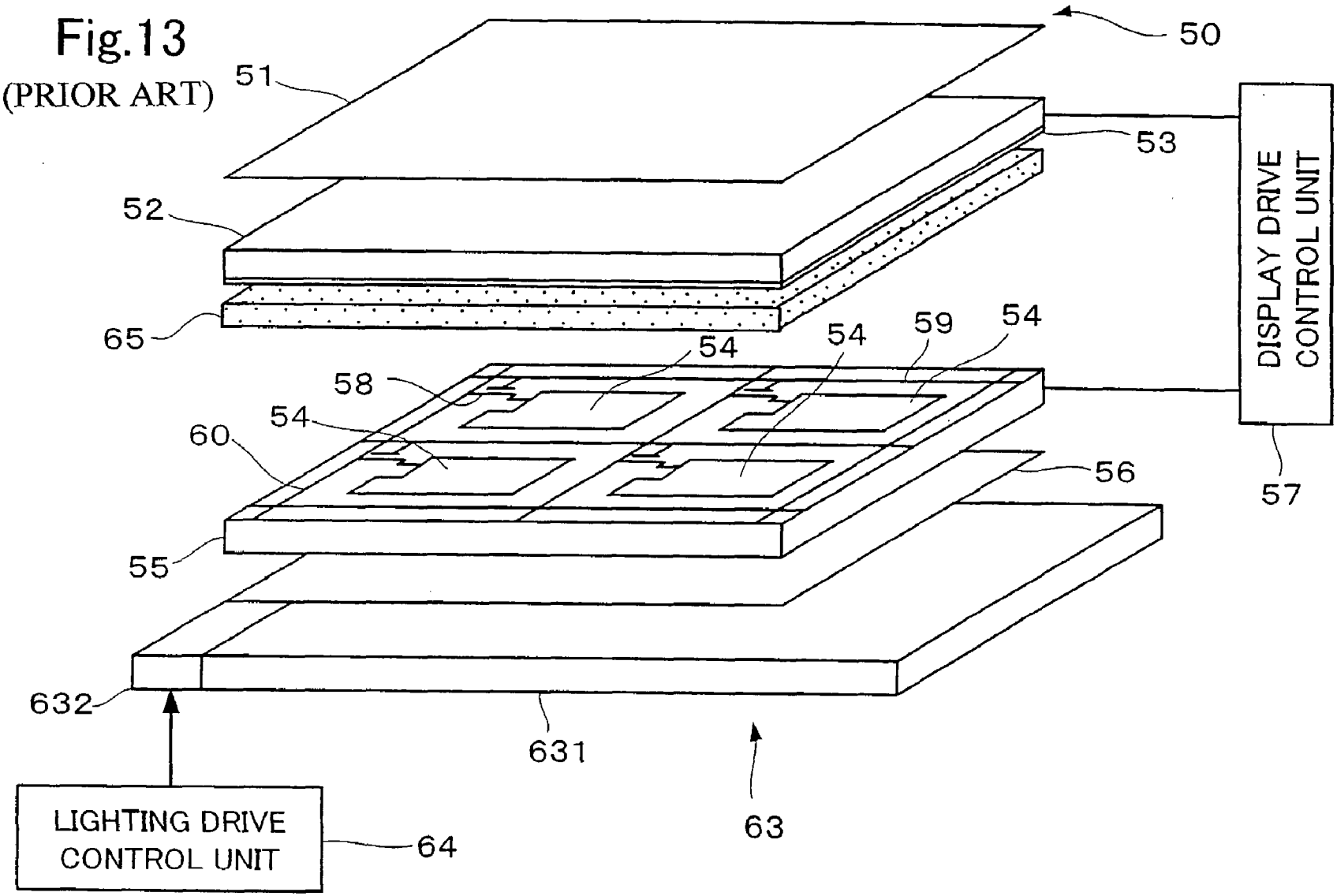
Fig.13 (PRIOR ART)
FIG. 13 is a perspective-projected view showing a configuration of a conventional liquid crystal display device.
Figure 14:
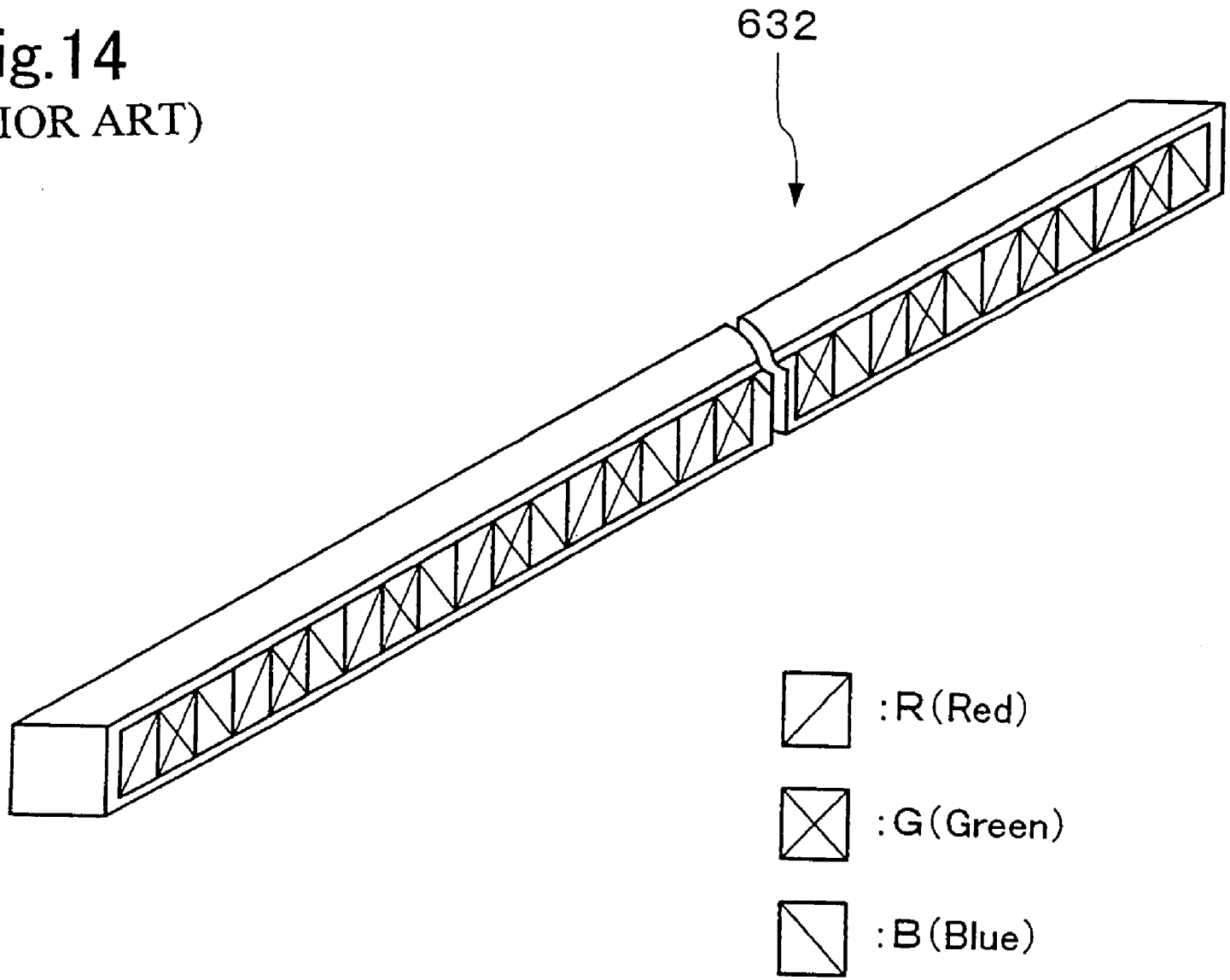
Fig.14 (PRIOR ART)
FIG. 14 is a perspective-projected view showing a configuration of an LED array in the liquid crystal display device shown in FIG. 13.

With such a configuration, the duty ratio of the pulse signal generated by the pulse generator 21 is set for each of RGB colors and stored in advance in the storage unit 71 such as an EEPROM connected to the pulse generator 21, whereby the drive voltage for the LEDs of respective colors 16*a* to 16*c* can be adjusted. For example, as shown in a timing chart in FIG. 12, when the red LED 16*a* emits light, the time of the positive side of the pulse signal is made longer to make the positive voltage developing at the secondary side of the switching transformer 12 lower. On the other hand, when the green LED 16*b* emits light, the time of the negative side of the pulse signal is made longer to make the positive voltage developing at the secondary side of the switching transformer 12 higher. According to the control described above, chromaticity modulation of the display color can be well performed. Needless to say, if the polarity of the switching transformer 12 is changed, the relation between the pulse signal and the developed voltage is inverted.

Other Embodiments

Up to this point, each embodiment of the present invention has been described, but specific modes for carrying out the present invention are not limited to the above embodiments. For example, though the control circuit of the backlight is described in each of the above embodiments, a front-light control circuit incorporated in a reflective liquid crystal display device may have a similar configuration.

As a liquid crystal material, a ferroelectric liquid crystal, anti-ferroelectric liquid crystal and the like are desired, but not limited thereto. Among these liquid crystal materials, especially, an OCB (Optically self-Compensated Birefringence) mode is desirable. The OCB mode aligns the liquid crystal molecules in the upper and lower substrates in the same direction at first (spray alignment state), and then makes the alignment of the liquid crystal molecules at the center of the panel bent by applying a DC voltage (bend alignment state) to drive, which has fast responsiveness.

Figure 15:
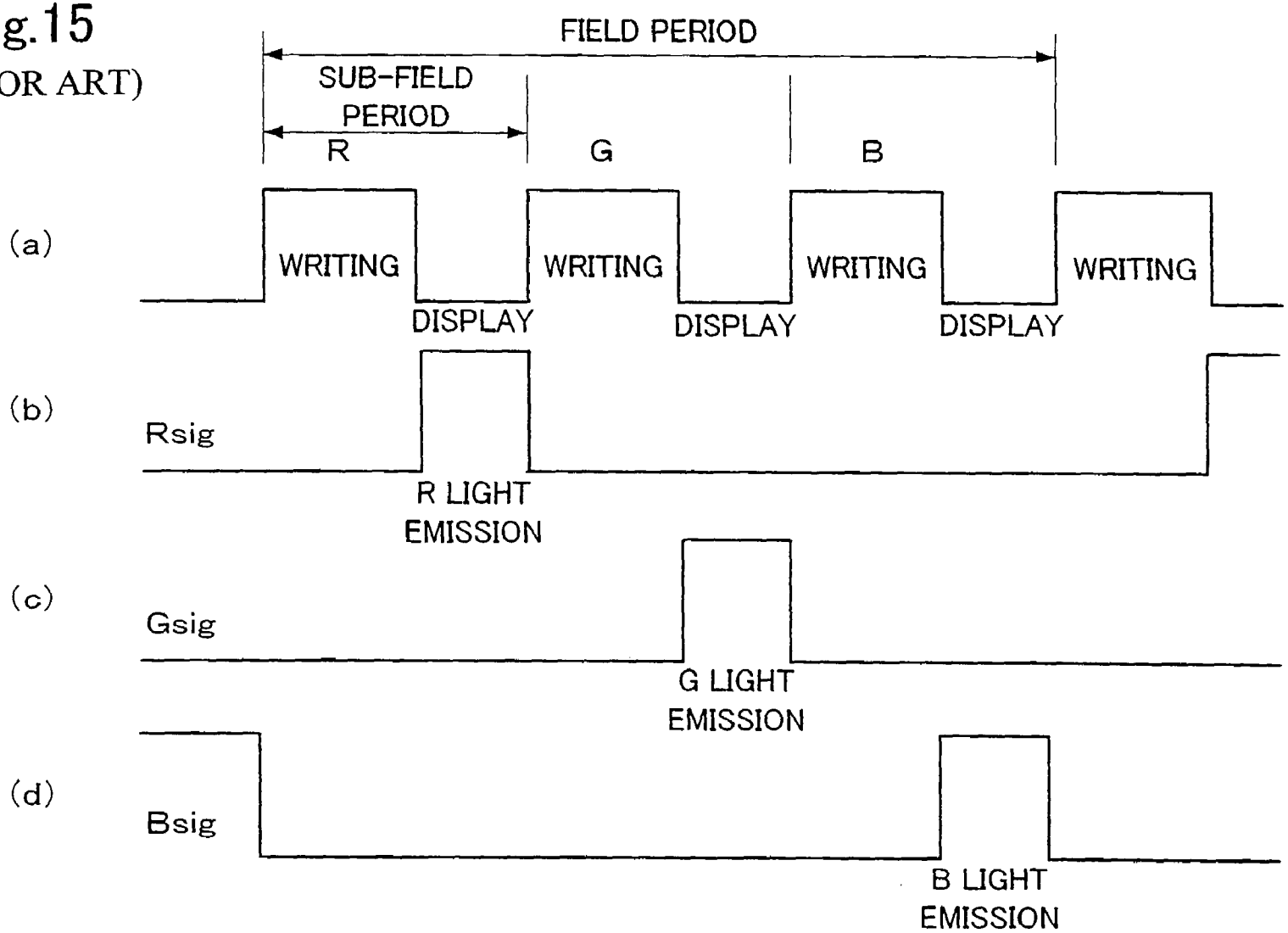
Fig.15 (PRIOR ART)
FIG. 15 is a timing chart showing an operation of a lighting drive control unit shown in FIG. 13.

The liquid crystal display device of the field sequential system is required to have a fast response speed of the liquid crystal. That is, the writing period as shown in FIG. 15(*a*) is actually a total of an actual writing time of image data and a response time, and therefore, if the response of the liquid crystal is slow, the light emission time is inevitably reduced, thus resulting in reduction of light emission intensity. Accordingly, the desirable response speed is within 1 to 2 ms and such a fast response can be realized in the OCB mode, and consequently, it has good compatibility with the field sequential system.

What is claimed is:

1. A liquid crystal display device comprising:

a liquid crystal display panel having a first substrate, a second substrate, a liquid crystal sandwiched between said first substrate and said second substrate, a plurality of pixel electrodes arranged in a matrix on said second substrate, a counter electrode provided on one of said first substrate and said second substrate and a plurality of switching elements connected to said respective plurality of pixel electrodes;

a display drive control unit for driving said liquid crystal sandwiched between each of said pixel electrodes and said counter electrode by switching each of said switching elements to apply a voltage to each of said pixel electrodes;

a lighting unit having LEDs emitting light of respective red, green and blue colors, and applying said light of each color toward said liquid crystal display panel; and a lighting drive control unit for making said LED of each color perform time-division light emission in synchronization with the switching of each of said switching elements, wherein said lighting drive control unit comprises a switching transformer which generates a drive voltage for said LED of each color at its secondary side based on a light emission control signal input to its primary side, and said switching transformer comprises a primary winding and a secondary winding at the primary side and the secondary side, respectively, said secondary winding comprising an output tap at some midpoint of the winding, and wherein at least one of said LEDs of respective colors is connected to an end portion of said secondary winding and one of remaining LEDs is connected to said output tap.

2. The liquid crystal display device according to claim 1, wherein said LED connected to said output tap is the LED of red color.

3. A liquid crystal display device comprising:

a liquid crystal display panel having a first substrate, a second substrate, a liquid crystal sandwiched between said first substrate and said second substrate, a plurality of pixel electrodes arranged in a matrix on said second substrate, a counter electrode provided on one of said first substrate and said second substrate and a plurality of switching elements connected to said respective plurality of pixel electrodes;

a display drive control unit for driving said liquid crystal sandwiched between each of said pixel electrodes and said counter electrode by switching each of said switching elements to apply a voltage to each of said pixel electrodes;

a lighting unit having LEDs emitting light of respective red, green and blue colors, and applying said light of each color toward said liquid crystal display panel; and a lighting drive control unit for making said LED of each color perform time-division light emission in synchronization with the switching of each of said switching elements, wherein said lighting drive control unit comprises a pulse generator which generates a pulse signal having a desired pulse width and a switching transformer which generates a drive voltage for said LED of each color at its secondary side based on said pulse signal input to its primary side, and modulates the pulse width of said pulse signal for each of said LEDs of respective colors.

4. The liquid crystal display device according to claim 3, wherein said pulse width is modulated so that the drive voltage applied to said LED of red color becomes the lowest.

* * * * *

UNITED STATES PATENT AND TRADEMARK OFFICE

CERTIFICATE OF CORRECTION

PATENT NO. : 7,248,245 B2
APPLICATION NO. : 11/483731
DATED : July 24, 2007
INVENTOR(S) : Katsumi Adachi et al.

It is certified that error appears in the above-identified patent and that said Letters Patent is hereby corrected as shown below:

On the title page,

After Item "(62)", insert
Item -- (30) Foreign Application Priority Data
June 28, 2001 (JP) 2001-196036 --

Signed and Sealed this

Thirtieth Day of October, 2007

JON W. DUDAS
*Director of the United States Patent and Trademark Office*